US008622651B2

(12) United States Patent
McFarland

(10) Patent No.: US 8,622,651 B2
(45) Date of Patent: Jan. 7, 2014

(54) WAVE GENERATING APPARATUS AND METHOD

(76) Inventor: Bruce McFarland, Solana Beach, CA (US)

( * ) Notice: Subject to any disclaimer, the term of this patent is extended or adjusted under 35 U.S.C. 154(b) by 211 days.

(21) Appl. No.: 12/943,876

(22) Filed: Nov. 10, 2010

(65) Prior Publication Data

US 2011/0052322 A1 Mar. 3, 2011

Related U.S. Application Data

(63) Continuation-in-part of application No. 12/700,042, filed on Feb. 4, 2010, which is a continuation-in-part of application No. 11/550,239, filed on Oct. 17, 2006, now Pat. No. 7,658,571, application No. 12/943,876, which is a continuation-in-part of application No. 12/700,036, filed on Feb. 4, 2010, now Pat. No. 8,303,213.

(51) Int. Cl.
*E02B 3/00* (2006.01)

(52) U.S. Cl.
USPC ..... 405/79; 472/128

(58) Field of Classification Search
USPC ..... 405/79, 76; 472/117, 128; 411/349, 411/549, 553
See application file for complete search history.

(56) References Cited

U.S. PATENT DOCUMENTS

| | | | | |
|---|---|---|---|---|
| 3,802,697 | A * | 4/1974 | Le Mehaute | 482/51 |
| 5,899,633 | A * | 5/1999 | Lochtefeld | 405/79 |
| 6,019,547 | A * | 2/2000 | Hill | 405/79 |
| 6,722,831 | B2 * | 4/2004 | Rogers et al. | 411/345 |

FOREIGN PATENT DOCUMENTS

JP 52041393 * 3/1977

* cited by examiner

*Primary Examiner* — Sean Andrish
(74) *Attorney, Agent, or Firm* — Manuel de la Cerra

(57) ABSTRACT

The teachings herein are directed to a wave forming apparatus including a bed form that may include a plurality of sections at different angles, including a base section adjacent to a wave forming channel, the base section having an exterior profile defining a first, non-abrupt angle to the direction of flow of water in the channel, and an upper section that forms an exterior profile defining a second, steeper angle to the direction of water flow. Also disclosed is a twistlock mechanism adapted to removably fasten a bed form to a water channel, and a method of use.

10 Claims, 7 Drawing Sheets

WAVE GENERATING APPARATUS AND METHOD

RELATED APPLICATIONS

The present application claims the benefit of, and incorporates herein by reference, application Ser. No. 11/550,239 for a Barreling Wave Generating Apparatus and Method, filed Oct. 17, 2006. The present application further claims the benefit of, and incorporates herein by reference, application Ser. No. 12/700,036 for a Wave Generating Apparatus and Method, filed Feb. 4, 2010. The present application also claims the benefit of, and incorporates herein by reference, application Ser. No. 12/700,042 for a Wave Generating Apparatus and Method, filed Feb. 4, 2010.

BACKGROUND

1. Field of the Invention

The present invention relates generally to a wave forming apparatus for water rides or water features of the type provided in water-based amusement parks, water features in ornamental gardens, and the like, and is particularly concerned with an apparatus for forming a barreling wave, also known as a tubing or tunneling wave, which can support surfing activities or produce an attractive visual effect in a fountain or the like, including a fastener system therefore.

2. Related Art

Naturally occurring waves occur in the ocean and also in rivers. These waves are of various types, such as moving waves which may be of various shapes, including tubular and other breaking waves. Surfers are constantly searching for good surfing waves, such as tubular breaking waves and standing waves. There are only a few locations in the world where such waves are formed naturally on a consistent basis. Thus, there have been many attempts in the past to create artificial waves of various types for surfing in controlled environments such as water parks. In some cases, a sheet flow of water is directed over an inclined surface of the desired wave shape. Therefore, rather than creating a stand-alone wave in the water, the inclined surface defines the wave shape and the rider surfs on a thin sheet of water flowing over the surface. In some cases, the inclined surface is shaped to cause a tubular form wave. Sheet flow wave simulating devices have some disadvantages. For example, since these systems create a fast moving, thin sheet of water, they produce a surfing experience different than a real standing wave.

In other wave forming devices, a wave is actually simulated in the water itself, rather than being defined by a surface over which a thin sheet of water flows. U.S. Pat. No. 6,019,547 to Hill describes a wave forming apparatus which attempts to simulate natural antidune formations in order to create waves. A water-shaping aerofoil is disposed within a flume containing a flow of water, and a wave-forming ramp is positioned downstream of the aerofoil structure. Various apparatus and methods for forming deep water standing waves are described in the following United States patents and applications, the entire contents of which are incorporated herein by reference: U.S. Pat. Nos. 6,629,803, 6,932,541 and 7,326,001, as well as U.S. patent application Ser. No. 11/550,239 for a Barreling Wave Generating Apparatus and Method, filed Oct. 17, 2006; U.S. patent application Ser. No. 11/958,785 for a Wave Forming Apparatus and Method, filed Dec. 18, 2007; and U.S. patent application Ser. No. 12/356,666 for an Adjustable Barreling Wave Generating Apparatus and Method, filed Jan. 21, 2009.

Water flowing against a wave foil can tend to backup near the base of the foil, due to the sudden discontinuity in the water flow direction. A smoothly-curved foil that blends tangent to the floor of the flume would tend to minimize the discontinuity in water flow and thus minimize the backup. However, in practice such smoothly-curved foils are typically prohibitively difficult and expensive to form. Also, with water flowing over and around the foil, the fasteners that hold the foil to the flume tend to corrode, making removal and replacement of foils difficult. Such fasteners can also present underwater hazards for users of the devices.

SUMMARY

Among other things, provided is a wave generating apparatus, comprising: a channel having a bottom, the channel adapted to direct a flow of water into contact with a bed form located in the channel, the channel and the bed form together being adapted to generate a barrel-shaped wave capable of supporting a person surfing when the flow of water contacts the bed form, the bed form comprising: a base section adjacent to the bottom of the channel, the base section having a substantially flat first exterior profile defining a first included angle between the first exterior profile and the bottom of the channel; and an upper section above the base section, the upper section having a substantially flat second exterior profile defining a second included angle between the second exterior profile and the bottom of the channel; wherein the second included angle is greater than the first included angle. In various embodiments, the first included angle may be less than forty-five degrees, while the second included angle may be greater than thirty degrees. In various embodiments, the bed form may comprise a barreling wave forming foil, may be substantially symmetrical about a vertical axis, may be located in the channel obliquely to the direction of water flow in the channel, and may be removably attached to the channel.

Also provided is a twistlock fastener system for a wave generating apparatus, comprising: a channel having a bottom, the channel adapted to direct a flow of water into contact with a bed form located at least partially adjacent the bottom of the channel, the channel and the bed form together being adapted to generate a barrel-shaped wave capable of supporting a person surfing when the flow of water contacts the bed form; the channel defining a first non-round through-hole through the bottom of the channel; the bed form defining a second non-round through-hole through the portion of the bed form adjacent the bottom of the channel, the first and second non-round through-holes being adapted to be substantially the same size, shape, orientation, and axially aligned with each other when the bed form is located at least partially adjacent the bottom of the channel. As part of the twistlock fastener system, provided is a twistlock fastener comprising: a longitudinally-extending main body having a top portion and a bottom portion and a non-round cross-section adapted to fit into, but not be able to rotate within, the first and second non-round through-holes when the bed form is located at least partially adjacent the bottom of the channel; a top locking member rotationally attached to the top portion of the main body; a bottom locking member rotationally attached to the bottom portion of the main body; the top locking member and the bottom locking member adapted to rotate relative to the main body from a first rotational position to a second rotational position when the main body is located in the first and second non-round through-holes. In this twistlock fastener system, the bed form is adapted to be locked to the channel when the main body is located in the first and second non-round through-holes and the top locking member and the bottom locking member are rotated relative to the main body from the first rotational position to the second rotational position; and the bed form is further adapted to be unlocked from the channel when the main body is located in the first and second non-round through-holes and the top locking member and the bottom locking member are rotated relative to the main body from the second rotational position to the first rotational position. In various embodiments, the top and/or bottom locking members are rotationally attached to the top portion of the main body at least in part by at least one of: a screw; a bolt; a rivet; a shaft; and/or a retaining clip. The first and second non-round through-holes may comprise an oblong shape, as may the non-round cross-section of the main body of the a twistlock fastener, which may be formed at least in part from stainless steel.

A method of is also provided for removably fastening a bed form to a channel in a wave generating apparatus, comprising the steps of: providing a twistlock fastener system as described above; locating the bed form at least partially adjacent the bottom of the channel such that the first and second non-round through-holes are adjacent and aligned; and locking the bed form to the channel by locating the main body of the twistlock fastener in the first and second non-round through-holes and rotating the top locking member and the bottom locking member relative to the main body from the first rotational position to the second rotational position. Additional steps may include unlocking the bed form from the channel by rotating the top locking member and the bottom locking member relative to the main body from the second rotational position to the first rotational position. In various embodiments the method may further comprise any of the steps of: removing the twistlock fastener from the first and second non-round through-holes; moving the bed form relative to the channel; and/or removing the bed form from the channel. In fastening the bed form to the channel, the top and/or bottom locking members may in various embodiments be rotated relative to the main body by an angle between about forty-five degrees to about one hundred thirty five degrees.

Other features and advantages of the present invention will become more readily apparent to those of ordinary skill in the art after reviewing the following detailed description and accompanying drawings.

BRIEF DESCRIPTION OF THE DRAWINGS

Details of the present invention, both as to its structure and operation, may be determined in part by study of the accompanying drawings, in which like reference numerals refer to like parts, and in which.

DETAILED DESCRIPTION

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

1. An Example Multi-Angle Bed Form for a Wave Forming Apparatus

Figure 1:
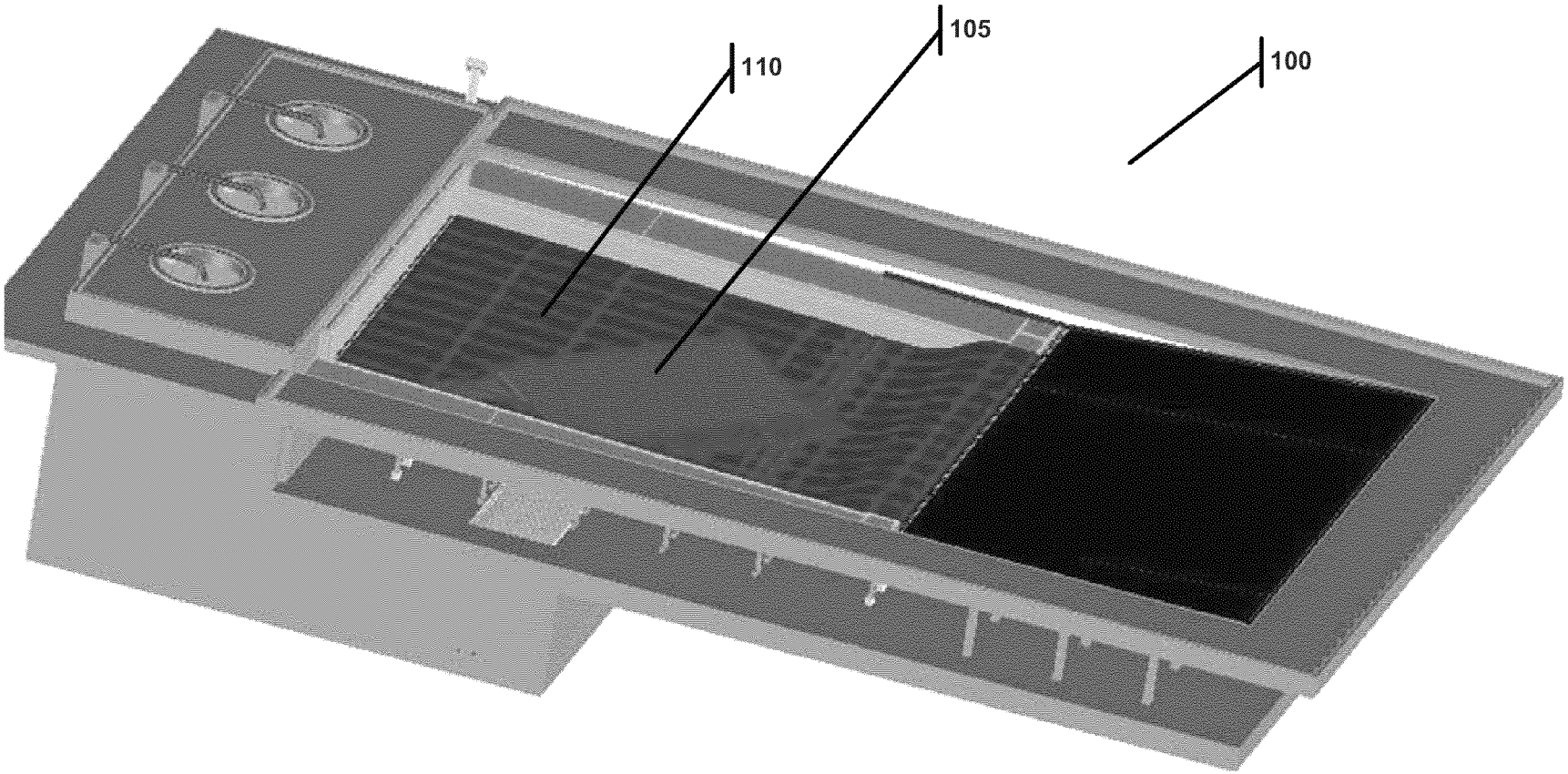
FIG. 1 is a perspective view of a wave forming apparatus according to one embodiment having an oblique foil with a steep upper section and a less-steep lower section.
Figure 2:
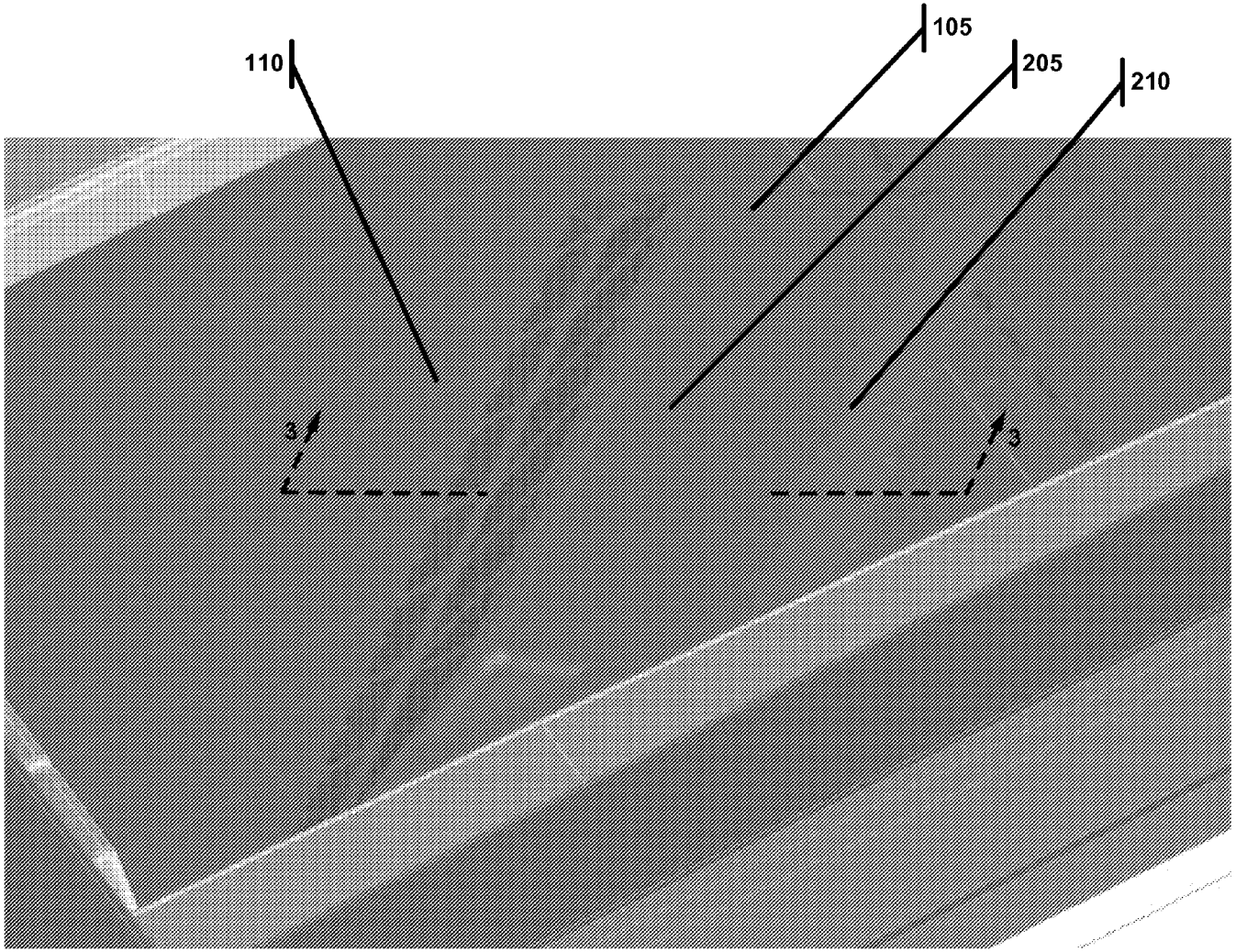
FIG. 2 is a closer perspective view of the wave forming apparatus of FIG. 1.
Figure 3:
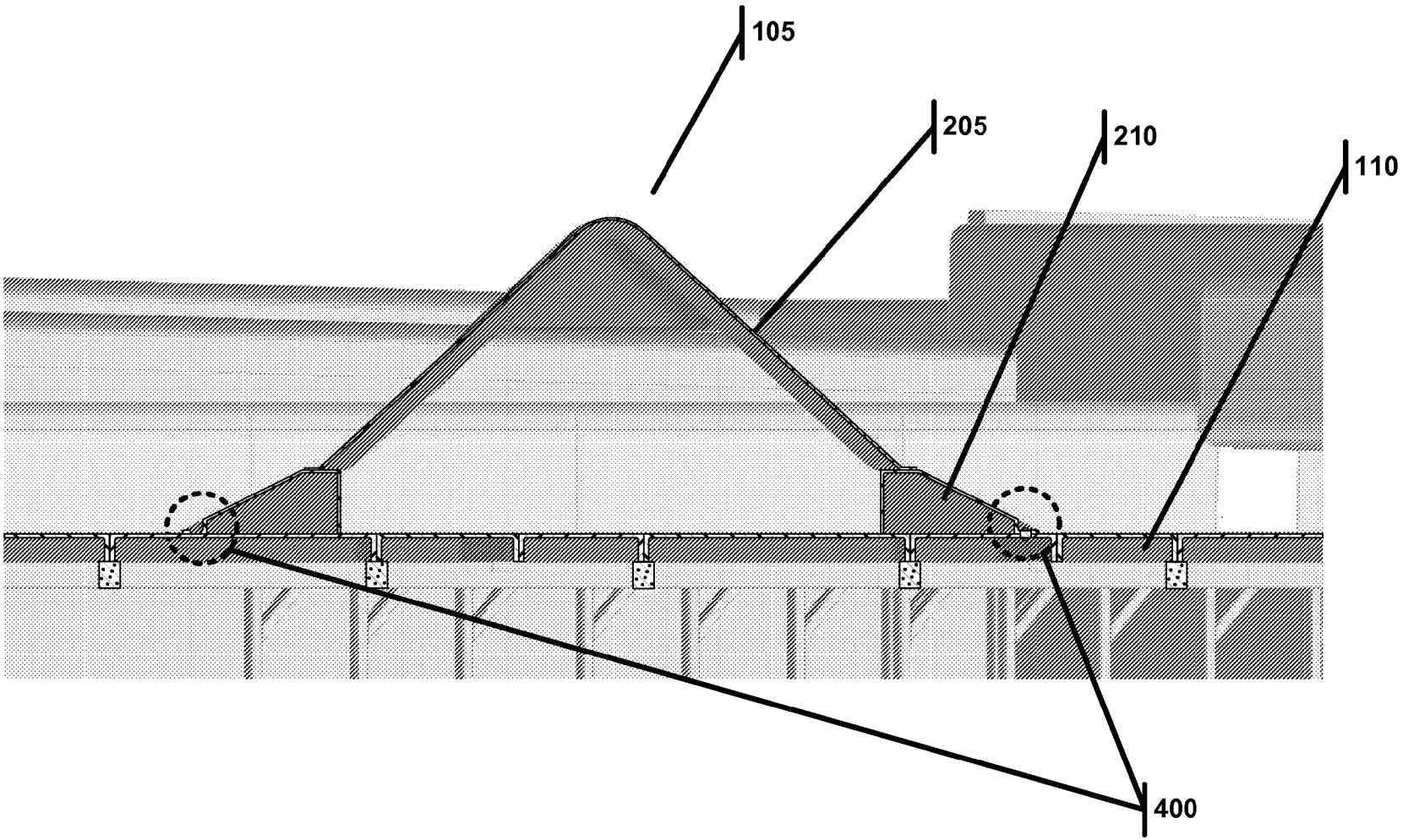
FIG. 3 is a cross-sectional perspective view along the line 3-3 of FIG. 2, showing construction of the foil in that embodiment.

FIGS. 1, 2, and 3 illustrate an example embodiment of an improved wave forming apparatus 100 designed to form barreling waves. An apparatus 100 may comprise a wave forming channel 110 for containing a flow of water. Except as otherwise provided herein, an example wave forming apparatus 100 may be similar to the apparatus described with respect to FIGS. 1, 2, 3, 4, 7, 8, 9A and 11 in pending application Ser. Nos. 12/700,036 and 12/700,042, both filed Feb. 4, 2010, and/or may be similar to FIGS. 39-41 in pending application Ser. No. 11/958,785 filed Dec. 18, 2007, all of which are incorporated herein in their entireties by reference.

A bed form, such as one or more barreling wave forming foils 105 may be mounted in the channel 110 at, for instance, an oblique angle to the flow direction of water along the channel 110, as shown in FIG. 1. The example bed form 105 of this embodiment may be of hollow construction entirely or in part, and may include additional features not shown, such as vents for providing additional flow paths for the water, as described in various applications incorporated herein by reference. Bed forms may alternatively be of solid or any other appropriate construction.

As best illustrated in FIG. 2, the exterior profile of a bed form, such as one or more barreling wave forming foils 105, may be provided with a base section 210 adjacent to the wave forming channel 110, the exterior profile of the base section 210 defining a first, non-abrupt angle to the direction of flow of water in the wave forming channel 110. In some embodiments the first angle is, for example, less than forty-five degrees (i.e., the first angle is the included angle between the exterior profile of the base section 210 and the floor of the water forming channel 110). The base section 210 may extend upward and transition to an upper section 205 at a second, steeper angle to the direction of water flow. In some embodiments the second angle is, for example, greater than thirty degrees (i.e., the second angle is the included angle between the exterior profile of the upper section 205 and the floor of the water forming channel 110). The exterior profiles of the base section 210 and/or the upper section 205 may define at least in part nominally flat panels. Nominally flat panels may not be perfectly flat due to manufacturing and assembly variations. The base section 210 and/or the upper section 205 may be formed on one or more leading sides of the bed form (i.e., the side(s) facing toward the oncoming flow of water), and/or on one or more trailing sides of the bed form (i.e., the side(s) facing away from the oncoming flow of water). Alternatively, as in the example shown in FIG. 2, a base section 210 and an upper section 205 may be formed on all sides of the bed form 105 that interface with the wave forming channel 110.

FIG. 3 shows a cross-section of an example bed form, namely a barreling wave forming foil 105, including a base section 210 with an exterior profile defining a first, non-abrupt angle to the direction of flow of water in the wave forming channel 110, where the base section 210 transitions to an upper section 205 that forms an exterior profile defining a second, steeper angle to the direction of water flow (that direction being generally from left to right, or right to left, in the orientation shown in FIG. 3). In the example shown in FIG. 3, the base section 210 is formed from a first structure and the upper section 205 is formed from a second structure connected to the first structure. The first structure may be permanently connected to the second structure, for instance by welding, or may be removably connected to the second structure, for instance by fasteners (not shown). In the example embodiment shown in FIG. 3, the bed form, a barreling wave forming foil 105, is at least approximately symmetrical about a central vertical axis. In other embodiments, the bed form may be non-symmetrical about a central vertical axis, such that the leading and trailing sides of the bed form have base sections 210 with exterior profiles that define different included angles to the wave forming channel 110, and/or such that the leading and trailing sides of the bed form have upper sections 205 with exterior profiles that define different included angles to the wave forming channel 110.

In other embodiments, bed forms may be provided with additional sections with exterior profiles that define additional angles to the wave forming channel 110, for instance three sections with three increasingly steep angles (not shown). Providing a bed form with multiple sections that define an exterior profile that increases in steepness as it rises above the wave forming channel 110 tends to allow the water in the wave forming channel 110 to flow better by limiting the amount of water backup near the base of the bed form, because the water meets the bed form at a gentler angle. This tends to generate smoother water and a better wave. Additionally, multi-angle designs incorporating substantially flat sections are typically substantially easier and less expensive to construct than concave or otherwise rounded sections.

Bed forms, such as a barreling wave forming foil 105, may be permanently connected to the wave forming channel 110, for instance by welding, or may be removably connected to the wave forming channel 110, for instance by fasteners or a fastener system, an example of which is described in the following section.

2. An Example Fastener System Adapted to Removably Attach a Bed Form to a Wave Forming Apparatus While bed form shapes have historically been permanently formed into the profile of the wave forming channel 110, the present inventor has invented bed forms that may also comprise separate modular components that can be removably secured in the channel 110 in various locations and positions as desired, as described in prior applications incorporated herein. For instance, one or more barreling wave forming foils 105 may each be separately constructed modular components adapted to be attached to, removed from, repositioned in and reoriented in channel 110. While any appropriate fastening or restraint means may be used, an example fastener system specially adapted to removably attach a bed form to a wave forming apparatus is described below.

FIG. 3 shows an example fastener system 400, shown in greater detail in FIGS. 4A, 4B, 4C, 4D, 5 and 6. System 400 may include a first oblong, elongated, or otherwise non-round through-hole 405 formed in a bottom surface 411 of a bed form, such as the base section 210 of a barreling wave forming foil 105. In certain embodiments, the system 400 may further include a second oblong, elongated, or otherwise non-round through-hole 115 formed in the channel 110. In the example shown in the above figures, holes 405 and 115 are adapted to match in size, orientation and location upon mounting the bed form into the channel 110. Alternatively, the hole 115 in the channel 110 may be a smaller size and/or a different shape than hole 405, for instance to prevent a fastener placed into hole 405 from falling through hole 115.

In the example shown in the above figures, holes 405 and 115 are adapted to accept a twistlock fastener 600, as shown in FIGS. 4C, 4D, 5 and 6. In the example shown in FIG. 6, a twistlock fastener 600 includes a longitudinally-extending main body 605 having a top portion and a bottom portion and an oblong, elongated, or otherwise non-round cross-section adapted to fit in but not rotate within correspondingly sized and shaped holes 405 and 115. Rotationally attached to the top portion of the main body 605 is a top locking member 610, and rotationally attached to the bottom portion of the main body 605 is a bottom locking member 615. Top and bottom locking members 610, 615 may be rotationally attached to the main body 605 by any suitable means, for example by rotation-permitting members 620, which may include, for instance, a screw, a bolt, a rivet, or a shaft having a head or other means for retaining the locking members 610, 615 to the main body 605, such as a retaining clip (not shown). The twistlock fastener 600 may be formed from any suitable material, such as stainless steel.

Figure 4A:
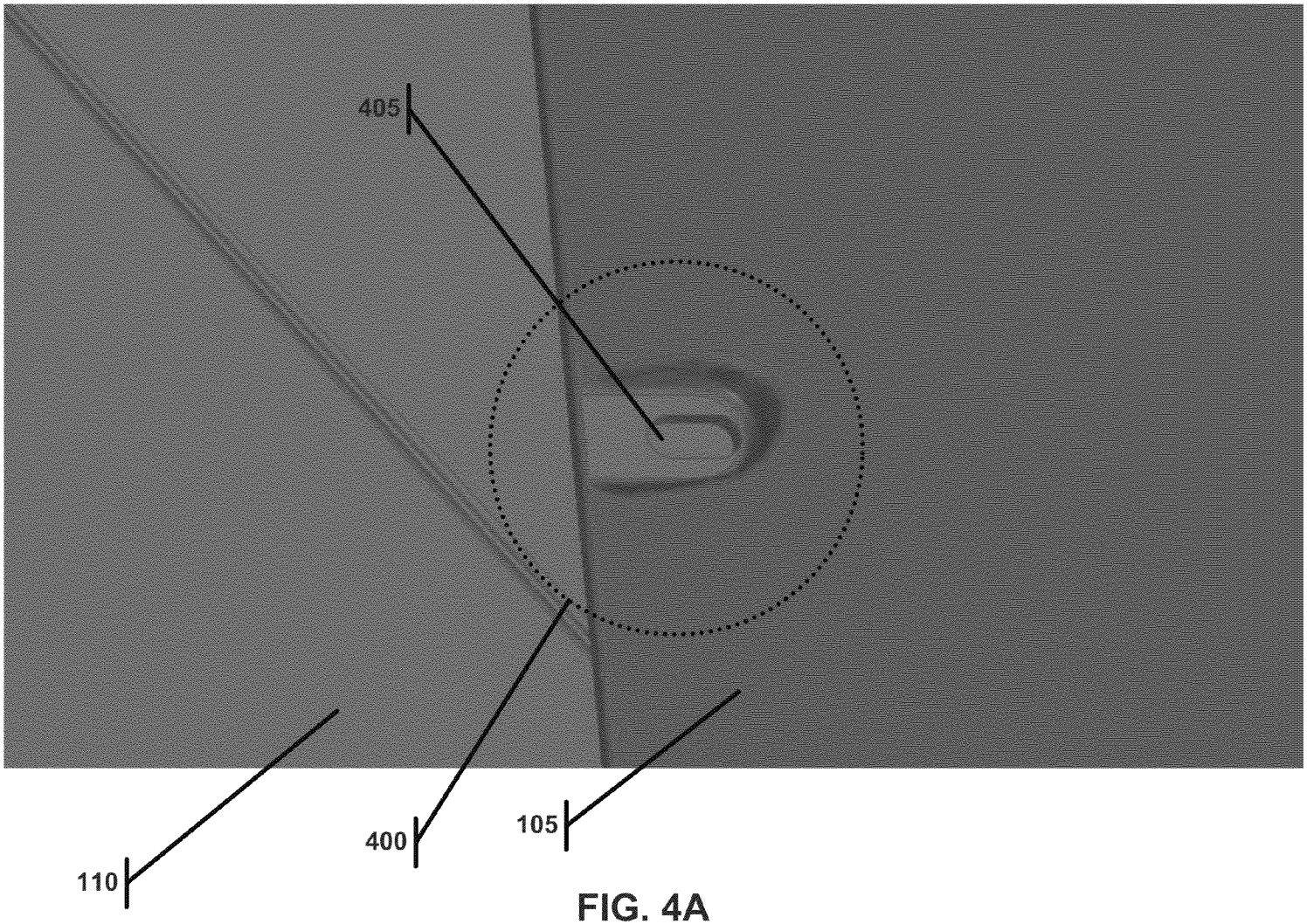
FIG. 4A is a perspective top view of the wave forming apparatus of FIG. 1, showing a recess and oblong hole formed in the foil adapted to interface with a fastener according to one embodiment.
Figure 4B:
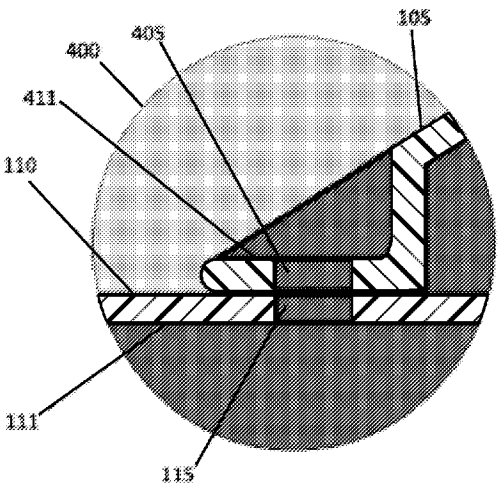
FIG. 4B is a cross-sectional side view along the line 3-3 of FIG. 2, partly cut away by line 400 as shown in FIG. 3, showing oblong holes formed in the foil and the bottom of the flume adapted to interface with a fastener according to one embodiment.
Figure 4C:
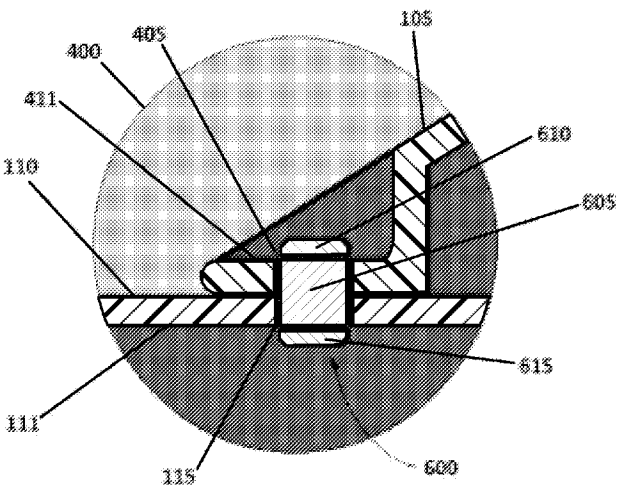
FIG. 4C is a cross-sectional side view along the line 3-3 of FIG. 2, partly cut away by line 400 as shown in FIG. 3, showing the wave forming apparatus of FIG. 4B, with a fastener according to one embodiment installed in an unlocked position.
Figure 4D:
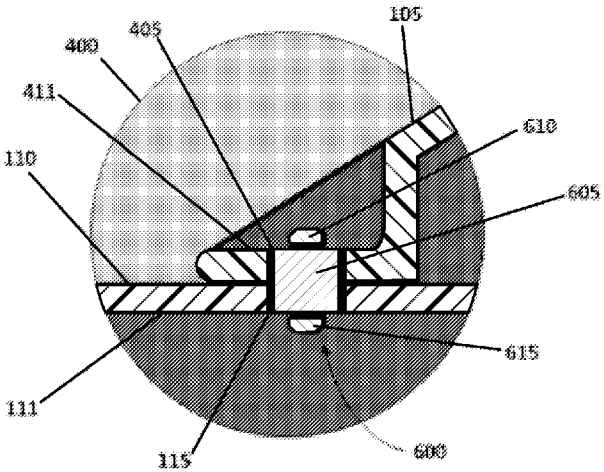
FIG. 4D is a cross-sectional side view along the line 3-3 of FIG. 2, partly cut away by line 400 as shown in FIG. 3, showing the wave forming apparatus of FIG. 4C according to one embodiment, with the fastener installed in a locked position.
Figure 5:
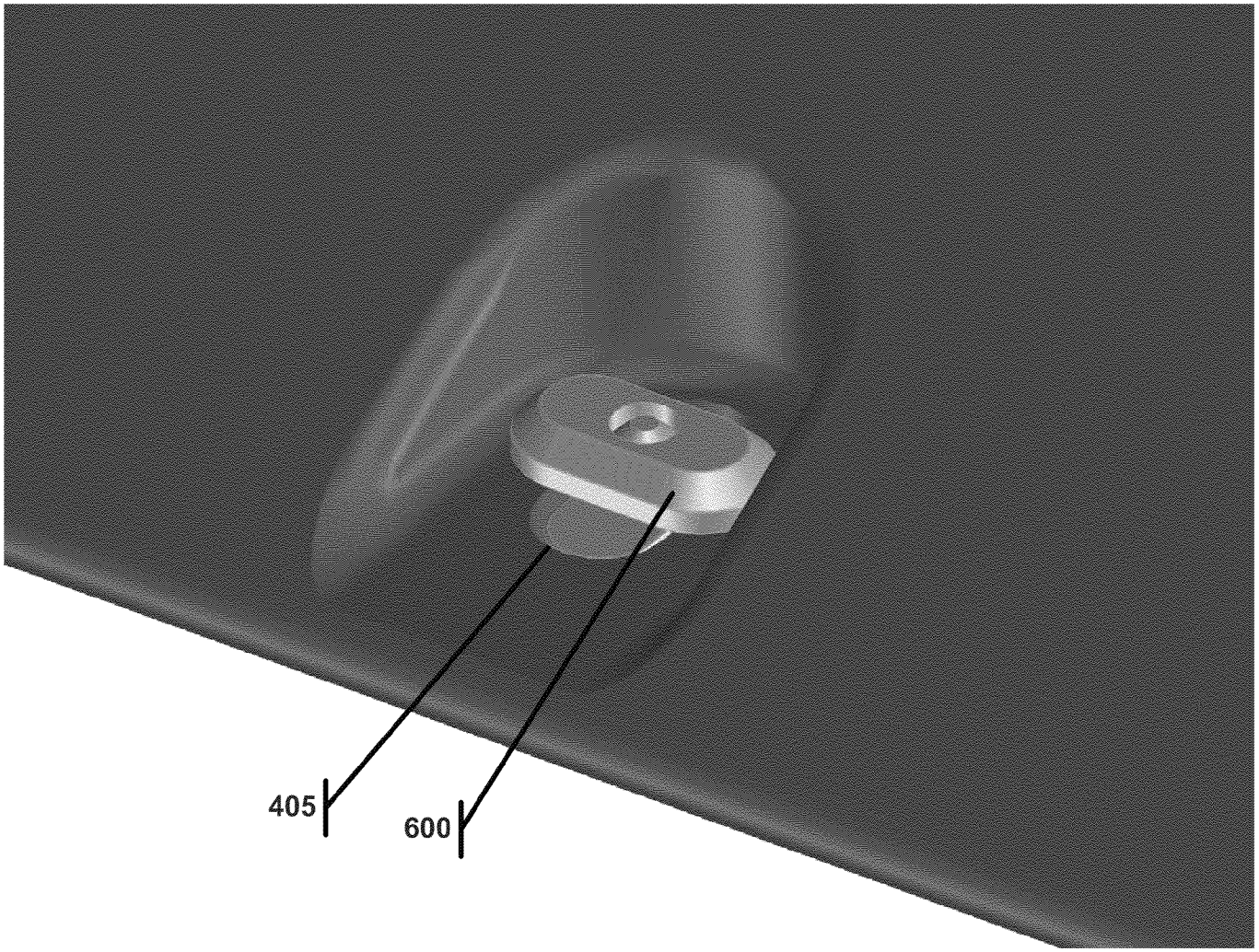
FIG. 5 is a perspective top view of the wave forming apparatus of FIG. 4D according to one embodiment, showing the fastener installed in a locked position.
Figure 6:
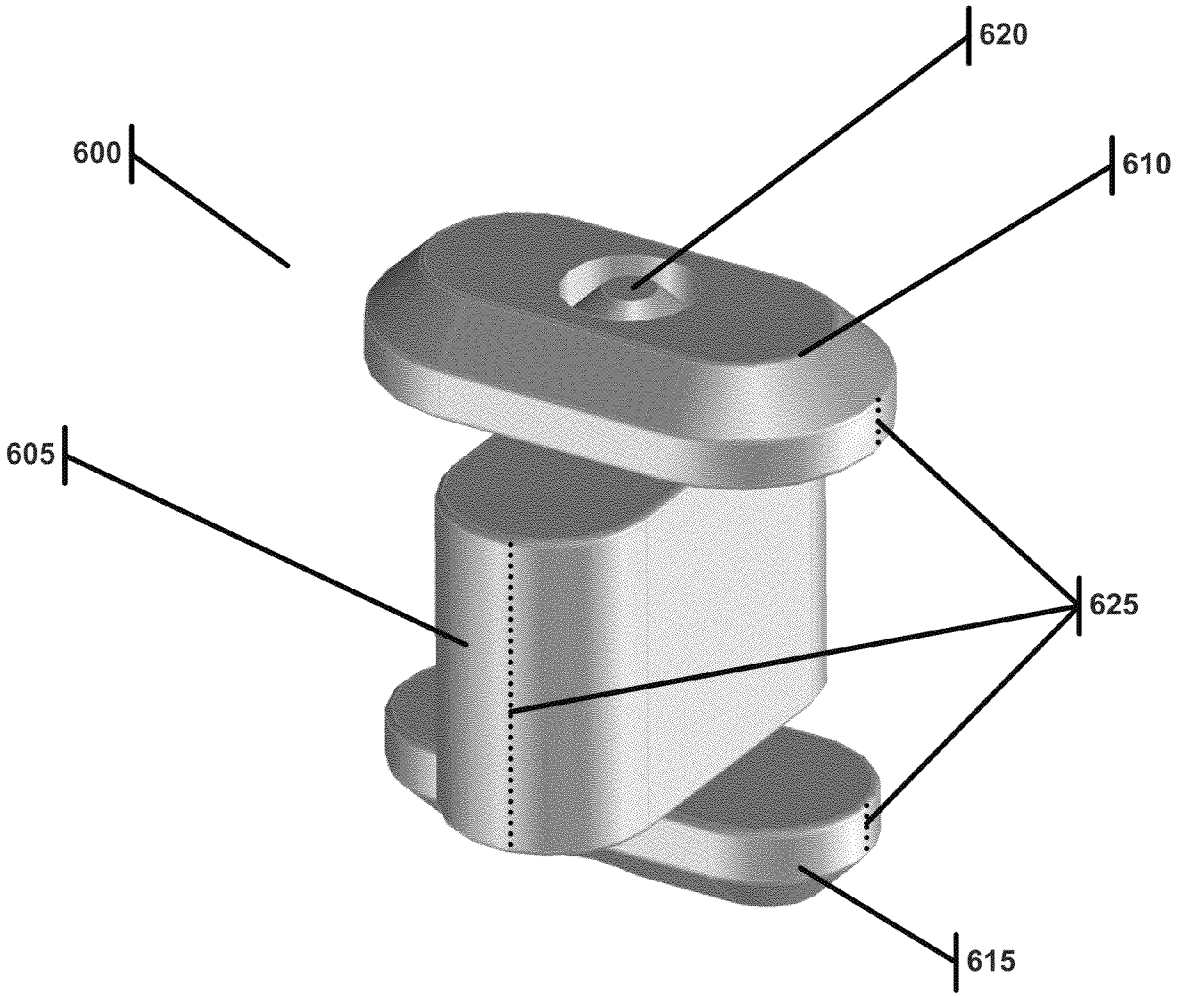
FIG. 6 is a perspective top view of the fastener of FIGS. 4C and 4D according to one embodiment, showing the fastener in a locked position.

In the example shown in the above figures, the twistlock fastener 600 may be installed in holes 405 and 115 when the top and/or bottom locking members 610, 615 are rotationally aligned with the main body 605. As shown in FIG. 6, such alignment would be achieved by rotating said pieces until dashed lines 625 were aligned. FIG. 4C shows an example twistlock fastener 600 installed in holes 405 and 115 with the locking members 610, 615 rotationally aligned with the main body 605. Rotating locking members 610, 615 relative to the main body 605, which is rotationally trapped within holes 405, 115, locks the twistlock fastener 600 in place, as shown in FIGS. 4D and 5. Specifically, when bottom locking member 615 is rotated (for instance approximately 45 to 135 degrees, such as for instance 90 degrees) relative to the main body 605 as shown in FIG. 6, then any attempt to move twistlock fastener 600 upwards (i.e., towards the bed form 105) will cause the bottom locking member 615 to push upward against the bottom surface 111 of the channel 110. Likewise, when top locking member 610 is rotated (for instance approximately 45 to 135 degrees, such as for instance 90 degrees) relative to the main body 605 as shown in FIG. 6, then any attempt to move twistlock fastener 600 downwards (i.e., towards the channel 110) will cause the top locking member 610 to push downward against an upper surface 411 of the bed form 105. Accordingly, once the example twistlock fastener 600 is installed in holes 405 and 115 with the locking members 610, 615 rotated with respect to the main body 605, as shown in FIGS. 4D and 5, then the bed form 105 will be securely fastened to the channel 110, preventing both vertical and lateral relative movement between the bed form 105 and the channel 110. Unfastening the bed form 105 from the channel 110 is achieved by simply rotationally realigning either the top and/or bottom locking members 610, 615 with the main body 605, such that dashed line segments 625 would be aligned, and removing the twist-lock fastener 600 from the holes 405, 115, after which the bed form 105 may be lifted off and/or moved on the channel 110. The fastener system 400 described herein may be used to connect a bed form or similar feature to any portion of a channel 110, including the bed or floor, and/or the walls thereof. The foregoing system 400 is quick and easy for a user to manipulate and may be adapted for use by hand without tools. The fastener system 400 may be located in recessed areas of a bed form 105, as shown most clearly in FIGS. 4A and 5, in some embodiments under removable covers (not shown).

Apparatus as described in each of the above embodiments may be scaled up or down depending on the type of water attraction desired. At a smaller scale it is suitable for inner tubing rather than surfing, and at an even smaller scale it may be used for a visual, fountain-like water feature rather than a ride. Larger scales of the apparatus may be used for surfing sports parks and events.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A wave generating apparatus, comprising:

a channel having a bottom, the channel adapted to direct a flow of water into contact with a bed form located in the channel, the channel and the bed form together being adapted to generate a barrel-shaped wave capable of supporting a person surfing when the flow of water contacts the bed form, the bed form comprising:

a base section adjacent to the bottom of the channel, the base section having a substantially flat first exterior profile defining a first included angle between the first exterior profile and the bottom of the channel; and an upper section above the base section, the upper section having a substantially flat second exterior profile defining a second included angle between the second exterior profile and the bottom of the channel;

wherein the first and second exterior profiles are arranged such that the flow of water flows over the first exterior profile and then flows over the second exterior profile;

wherein the second included angle is greater than the first included angle and the first included angle is greater than five degrees and wherein both the first and second included angles are acute.

2. The wave generating apparatus of claim 1, wherein the first included angle is less than forty-five degrees.

3. The wave generating apparatus of claim 1, wherein the second included angle is greater than thirty degrees.

4. The wave generating apparatus of claim 1, wherein the bed form comprises a barreling wave forming foil.

5. The wave generating apparatus of claim 1, wherein the bed form is substantially symmetrical about a vertical axis.

6. The wave generating apparatus of claim 1, wherein the bed form is located in the channel obliquely to the direction of water flow in the channel.

7. The wave generating apparatus of claim 1, wherein the bed form is removably attached to the channel.

8. The apparatus of claim 1, further comprising a fastener adapted to removably fastened the bed form to the channel.

9. The apparatus of claim 8, wherein the fastener is selected from a group consisting of: a screw; a bolt; a rivet; a shaft; a retaining clip; and a twistlock.

10. The apparatus of claim 8, wherein the fastener is formed at least in part from stainless steel.

* * * * *